United States Patent [19]

Fraser, Jr. et al.

[11] Patent Number: 4,904,165

[45] Date of Patent: Feb. 27, 1990

[54] MUFFLER/CHECK VALVE ASSEMBLY FOR SCROLL COMPRESSOR

[75] Inventors: Howard H. Fraser, Jr., Lafayette; William R. Lane, Dewitt; Shahrokh Etemad, East Syracuse, all of N.Y.

[73] Assignee: Carrier Corporation, Syracuse, N.Y.

[21] Appl. No.: 227,389

[22] Filed: Aug. 2, 1988

[51] Int. Cl.[4] ..... F04B 39/12

[52] U.S. Cl. ..... 417/312; 418/55

[58] Field of Search ..... 418/55 R, 181; 417/312; 181/240, 403; 62/296

[56] References Cited

U.S. PATENT DOCUMENTS

| | | | |
|---|---|---|---|
| 4,759,696 | 7/1988 | Ishiai | 418/270 |
| 4,762,477 | 8/1988 | Hayano et al. | 418/88 |
| 4,767,293 | 8/1988 | Caillat et al. | 418/57 |

FOREIGN PATENT DOCUMENTS

| | | | |
|---|---|---|---|
| 170877 | 10/1983 | Japan | 418/181 |
| 129177 | 6/1988 | Japan | 417/269 |

*Primary Examiner*—Leonard E. Smith

*Attorney, Agent, or Firm*—David J. Zobkiw

[57] ABSTRACT

A multi-functional, single member serves as a muffler to attenuate noise, as a separator plate between the suction and discharge gases/pressures, and to carry check valve structure to avoid reverse rotation and for efficiency enhancement at off-design conditions.

7 Claims, 2 Drawing Sheets

MUFFLER/CHECK VALVE ASSEMBLY FOR SCROLL COMPRESSOR

BACKGROUND OF THE INVENTION

Hermetic compressors are designated high side or low side depending upon whether a major portion of the shell or casing is filled with discharge gas or suction gas, respectively. Since suction gas is delivered through the shell to the compressor and discharge gas is delivered from the compressor through the shell to the refrigeration system, it is necessary to keep the two flows isolated from each other. In high side compressors, for example, it is common to deliver the suction gas via a suction line directly to the compression chamber and to pass the compressed gas to the interior of the shell and then out the discharge line. For low side compressors, if an internal muffler is desired, there must be a portion of the shell at discharge pressure unless the casing is enlarged to provide for the placement of a sealed muffler therein and the heat transfer between the muffler and suction gas is ignored. For scroll compressors, a check valve must be located in the discharge passage to prevent the compressor from running as an expander due to the reversed pressure differential upon stopping.

SUMMARY OF THE INVENTION

A low side scroll compressor is provided with an assembly which has an outer portion which separates the high pressure gas from the low pressure gas. An inner portion defines a muffler to attenuate discharge pulsations and noise. The inner portion also carries a check valve to prevent reverse rotation of the scroll wraps due to the reversed pressure differential when the compressor is stopped. Also, by locating the check valve at, or closed to, the discharge port, it can contribute to efficiency enhancement at off-design operation.

It is an object of this invention to provide a single assembly incorporating a muffler, separator plate and check valve. It is anogher object of this invention to locate the check valve at the discharge port for off-condition performance improvement. These objects, and others as will become apparent hereinafter, are accomplished by the present invention.

Basically, the shell of a hermetic compressor is divided into a suction plenum and a discharge plenum by a separator plate. The separator plate is a portion of a combined muffler, separator plate and check valve assembly.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
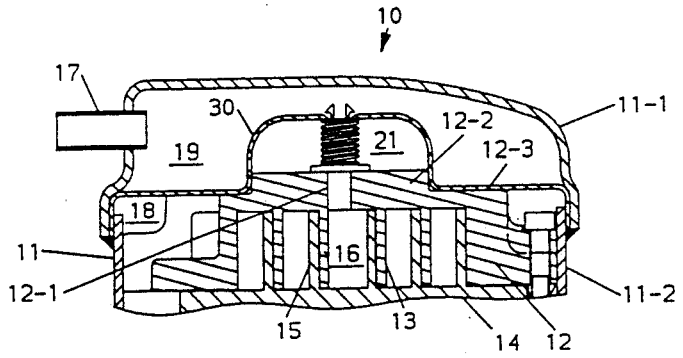
FIG. 1 is a partial cutaway sectional view of a portion of a low side hermetic scroll compressor employing the present invention.
Figure 2:
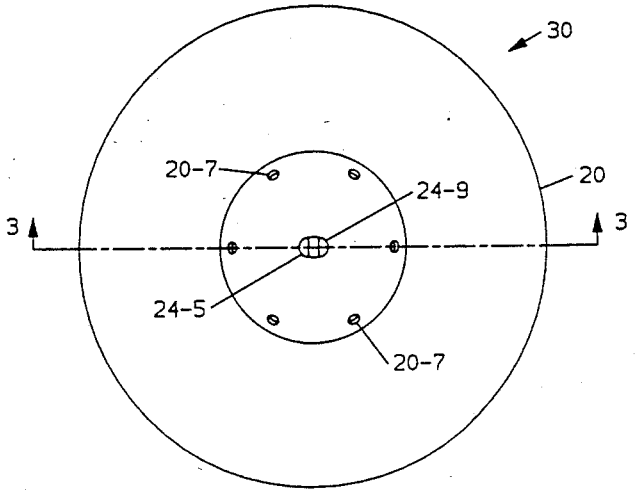
FIG. 2 is a top view of the present invention.
Figure 3:
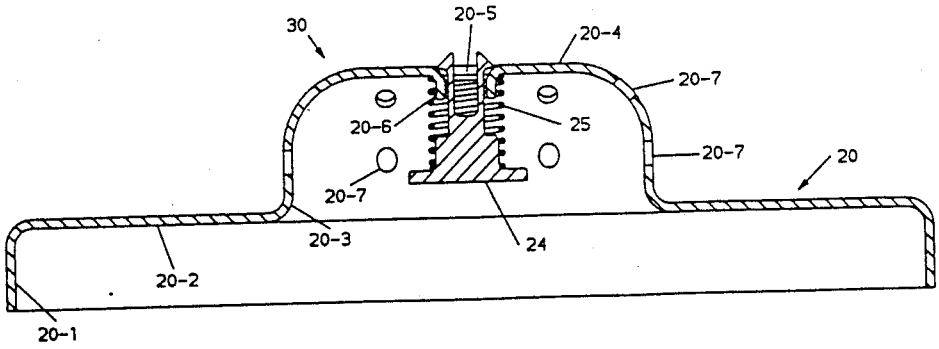
FIG. 3 is a sectional view taken along line 3—3 of FIG. 2.
Figure 4:
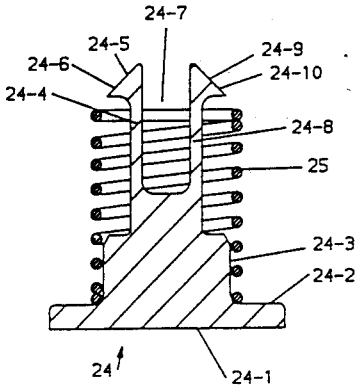
FIG. 4 is a sectional view of the valve structure.

In FIG. 1, the numeral 10 generally designates a low side hermetic scroll compressor having a shell or casing 11. A fixed scroll 12 having a wrap 13 and an orbiting scroll 14 having a wrap 15 are located in shell or casing 11 in any suitable manner. A generally axial discharge port 12-1 is formed in fixed scroll 12. The side of fixed scroll 12 opposite wrap 13 and through which discharge port 12-1 extends includes a raised central cylindrical portion 12-2 projecting from a flat, annular portion 12-3. As best shown in FIGS. 2 and 3, combined muffler, separator plate and check valve assembly 30 includes a single plate member 20 having an outer axially extending annular portion 20-1, an outer flat annular portion 20-2, an inner axially extending annular portion 20-3, an inner annular portion 20-4 surrounding a collar 20-6 defining port 20-5. Referring again to FIG. 1, it will be noted that shell or casing 11 includes an upper shell 11-1 and a middle shell 11-2 with outer axially extending annular portion 20-1 being located and welded or otherwise hermetically sealed between shells 11-1 and 2 in the assembled compressor 10. Flat annular portion 12-3 engages outer flat annular portion 20-2 such that flat annular portion 20-2 is distorted slightly so as to produce a spring bias tending to keep flat annular portions 12-3 and 20-2 in engagement. Additionally an adhesive or other suitable sealing means is provided between flat annular portions 12-3 and 20-2 to keep them in engagement and to provide a seal. With member 20 thus sealed to casing 11 and fixed scroll 12, the interior of casing 11 is divided into a suction plenum 18 and a discharge plenum 19 so that the differential pressure across member 20 also tends to keep flat annular portions 12-3 and 20-2 in engagement.

With flat annular portions 12-3 and 20-2 in engagement, inner axial annular portion 20-3 and inner flat annular portion 20-4 define a generally cylindrical muffler and separate discharge port 12-1 from discharge plenum 19. Assembly 30 further includes check valve member 24 and coil spring 25. Valve member 24 is made of a suitable light weight and durable material such as plastic and includes a flat portion 24-1 which engages raised central cylindrical cylindrical portion 12-2 to block discharge port 12-1, a cylindrical portion 24-3 coacting with flat portion 24-1 to define shoulder 24-2, and a pair of axially extending legs 24-4 and 8 which are separated by slot 24-7 and terminate in radially extending feet 24-5 and 9 having axially tapered portion 24-6 and 10, respectively. In assembling the check valve member 24 in assembly 30, spring 25 is placed over legs 24-4 and 8 and cylindrical portion 24-3 so that one end of spring 25 rests on shoulder 24-2. Tapered portions 24-6 and 10 of feet 24-5 and 9 are inserted into collar 20-6 and forced thereinto so that legs 24-4 and 8 are deflected inwardly permitting feet 24-5 and 9 to enter and pass through collar 20-6. When feet 24-5 and 9 pass through collar 20-6, the resiliency of legs 24-4 and 8 cause them to return to their unstressed positions whereby feet 24-5 and 9 prevent removal of valve 24 from collar 20-6. In the assembled device, the other end of spring 25 surrounds collar 20-6 and tends to bias valve 24 into engagement with fixed scroll 12 whereby flat portion 24-1 closes discharge port 12-1.

In operation, high pressure gas compressed by the motion of orbiting scroll 14 relative to fixed scroll 12 exits the compression chamber 16 through discharge port 12-1 by lifting valve member 24 against the bias of spring 25. The compressed gas passing through discharge port 12-1 enters the muffler cavity 21 formed by plate member 20 and fixed scroll 12. The compressed gas passes from muffler cavity 21 to discharge plenum 19 via holes 20-7 in portions 20-3 and/or 20-4 of plate member 20. Depending upon the spacing between the coils of spring 25 and the position of slot 24-7 when valve member 24 is open, an additional fluid path between muffler cavity 21 and discharge plenum 19 may be established. The compressed gas passes from discharge plenum 19 via discharge tube 17 which connects to the condenser (not illustrated) of a refrigeration system.

Upon the stopping of compressor 10, the high pressure gas in discharge plenum 19 would tend to run the compressor backwards, i.e. as an expander, unless so prevented by the valve 24. Additionally, because discharge plenum 19 is connected to the condenser of a refrigeration circuit (not illustrated) liquid refrigerant can be drawn into the compressor and cause liquid slugging upon start of the compressor.

Although a preferred embodiment of the present invention has been illustrated and described in terms of a scroll compressor, it is applicable to other types of rotary compressors so that other modifications will occur to those skilled in the art. For example, the valve structure can be the discharge valve(s) of a reciprocating compressor. It is therefore intended that the present invention is to be limited only by the scope of the appended claims.

What is claimed is:

1. A combined muffler and separator plate for use in a hermetic compressor having a casing and compressing means in said casing comprising:

a single member having a first portion adapted to be located in and sealed to said casing;

said member having a second portion adapted to be fixedly sealed to said compressing means whereby said member coacts with said casing and said compressing means to divide said casing into a suction plenum and a discharge plenum;

said member having a third portion defining a muffler.

2. A combined muffler and separator plate for use in a hermetic compressor having a casing and compressing means in said casing comprising:

a single member having a first portion adapted to be located in and sealed to said casing;

said member having a second portion adapted to be sealed to said compressing means whereby said member coacts with said casing and said compressing means to divide said casing into a suction plenum and a discharge plenum;

said member having a third portion defining a muffler;

valve means; and said third portion including means for receiving and supporting said valve means.

3. A combined muffler and separator plate comprising:

a single member having first, second, and third portions;

said first portion defining a muffler means;

said second portion extending radially outwardly from said first portion and including an annular section adapted to be sealed to the compressing means of a hermetic compressor;

said third portion located radially outward from said second portion and adapted to be sealed to the casing of a hermetic compressor whereby said second portion will function as a separator plate for separating a suction plenum from a discharge plenum.

4. The combined muffler and separator plate of claim 3 further including valve means and said first portion including means for receiving and supporting said valve means.

5. A combined muffler, separator plate and check valve comprising:

valve means;

a single member having first, second and third portions;

said first portion having means for receiving and supporting said valve means and defining a muffler means;

said second portion surrounding said first portion and including a region adapted to be sealed to the compressing means of a hermetic compressor;

said third portion surrounding said second portion and adapted to be sealed to the casing of a hermetic compressor whereby said second portion will function as a separator plate for separating a suction plenum from a discharge plenum.

6. The combined muffler, separator plate and valve of claim 5 wherein said first portion is generally cylindrical, said second portion is radially extending and generally annular and said third portion is axially extending and generally annular.

7. The combined muffler, separator plate and valve of claim 5 wherein said valve is a normally closed check valve.

* * * * *